219-121 SR
7/8/86 XR 4,598,449

United States Patent [19]

Monhardt et al.

[11] Patent Number: 4,598,449

[45] Date of Patent: Jul. 8, 1986

[54] BEAM FOR A CONTAINMENT STRUCTURE

[75] Inventors: Richard J. Monhardt, Glastonbury; Alfred B. Orr, West Suffield; Joseph B. Wright, Somers, all of Conn.

[73] Assignee: United Technologies Corporation, Hartford, Conn.

[21] Appl. No.: 678,842

[22] Filed: Dec. 3, 1984

Related U.S. Application Data

[62] Division of Ser. No. 332,694, Dec. 21, 1981, Pat. No. 4,500,252.

[51] Int. Cl.[4] ..... B21D 53/00; F01D 5/10

[52] U.S. Cl. ..... 29/157 R; 29/428; 29/462; 29/DIG. 38; 29/DIG. 48; 219/121 EC; 219/122 ED; 415/119; 415/219 R; 416/192

[58] Field of Search ..... 29/157 R, 156.8 R, 428, 29/462, DIG. 38, DIG. 48; 219/121 EC, 121 ED; 415/9, 119, 196, 197, 219 R; 416/190, 192, 218, 230

[56] References Cited

U.S. PATENT DOCUMENTS

| | | | |
|---|---|---|---|
| 2,988,302 | 6/1961 | Smith | 415/119 X |
| 2,999,667 | 9/1961 | Morley | 415/196 |
| 3,481,427 | 12/1969 | Dobbs et al. . | |
| 4,149,824 | 4/1979 | Adamson | 415/9 |
| 4,411,589 | 10/1983 | Joubert et al. | 415/9 |

FOREIGN PATENT DOCUMENTS

| | | | |
|---|---|---|---|
| 27756 | 4/1981 | European Pat. Off. | 415/9 |
| 30179 | 6/1981 | European Pat. Off. | 415/9 |
| 1245415 | 9/1971 | United Kingdom . | |
| 1480378 | 7/1977 | United Kingdom . | |

OTHER PUBLICATIONS

*Development of Advanced Light Weight Containment Systems—Final Report,* prepared for NASA (Lewis Research Center), by C. L. Stotler of General Electric Company under NASA contract NAS3-21823; Pub. No. NASA-CR-165212 (May 1981).

*Primary Examiner*—Howard N. Goldberg
*Assistant Examiner*—R. S. Wallace
*Attorney, Agent, or Firm*—Gene D. Fleischhauer

[57] ABSTRACT

An annular beam 46 which is hollow and which extends circumferentially about an annular flow path 22, 24 for working medium gases is disclosed. The annular beam supports and positions both a shroud 42 and a fabric 44 for containing particles having axial and radial velocity. The annular beam has a first wall 48 and a second wall 50. The second wall is spaced radially from the first wall. A plurality of annular plates 52 extending circumferentially about the interior of the beam. The plates are attached to the first wall and to the second wall. In one detailed embodiment the annular plates have a C-shaped cross section formed of a circumferentially extending rib 58 and two axially oriented legs 60, 62. The radial height of the rib is many times greater than the radial height of the legs. A method of fabricating the annular beam is disclosed. One detailed method includes the steps of inserting the annular plates into a gap between the inner wall and the outer wall, securing each annular plate in turn by spot welding the plate to the walls to place the legs of the plate in abutting relationship with the walls, and rotating the assembly of the walls and the plates beneath a device for directing a stream of energy, such as an electron beam welder, to join the walls to the legs.

5 Claims, 3 Drawing Figures

BEAM FOR A CONTAINMENT STRUCTURE

This is a division of application Ser. No. 332,694 filed on Dec. 21, 1981 now U.S. Pat. No. 4,500,252 issued Feb. 19, 1985.

CROSS REFERENCE TO RELATED APPLICATIONS

This application relates to U.S. application Ser. No. 332,693 filed Dec. 21, 1981 (now U.S. Pat. No. 4,452,565) for CONTAINMENT STRUCTURE by Richard J. Monhardt et. al., U.S. application Ser. No. 332,695 filed Dec. 21, 1981 (now U.S. Pat. No. 4,490,092) for CONTAINMENT STRUCTURE by Emile J. Premont; U.S. application Ser. No. 647,195 filed Sept. 4, 1984 for CONTAINMENT STRUCTURE by Emile J. Premont; U.S. application Ser. No. 332,696 filed Dec. 21, 1981 (now U.S. Pat. No. 4,475,864) for CONTAINMENT STRUCTURE by Angelo M. Patacca et al.; U.S. application Ser. No. 332,697 filed Dec. 21, 1981 (now U.S. Pat. No. 4,484,856) for CONTAINMENT STRUCTURE by Angelo M. Patacca et al.; U.S. application Ser. No. 585,069 filed Mar. 1, 1984 for CONTAINMENT STRUCTURE by Angelo M. Patacca; U.S. application Ser. No. 332,698 filed Dec. 21, 1981 (now U.S. Pat. No. 4,452,563) for CONTAINMENT STRUCTURE by Angelo M. Patacca et al.

TECHNICAL FIELD

This invention relates to an apparatus for supporting and positioning a fabric adapted to contain particles having an axial component of velocity and a radial component of velocity. The invention has particular application to the field of axial flow rotary machines and to the containment of particles resulting from the separation of the rotor blade from a rotating assembly in such a machine but is not limited to the field of axial flow rotary machines.

BACKGROUND ART

In axial flow rotary machines, rotor assemblies are driven at high rotational speeds about an axis of rotation. The rotor assemblies include rotor disks and rotor blades. Foreign objects, such as birds, hailstones or other objects, which on occasion are ingested into the engine may strike the blades causing parts of the rotor assembly to fragment or to separate from the rotor disk. During such a failure pieces of the rotor assembly may be hurled outwardly from the rotor assembly with velocities of several hundred feet per second. Such velocities typically have components in the axial, tangential and radial directions. One device for containing such fragments is shown in British Patent Specification No. 1,245,415 issued to Mottram et al entitled "Improvements in or Relating to Fluid Flow Machines". Mottram shows a containment structure formed of two similar metal strip members wound together to form a helical shield. The shield is wound about a solid casing. U.S. Pat. No. 2,999,667 entitled "Protective Arrangement for Use with Apparatus or Machines Having Rotating Parts" issued to Morley shows a containment structure formed of a web of interwoven wires which are continuous from one end of the web to the other. The web is supported in coil form in a first casing between an inner wall and a slidable outer wall. A second casing is spaced radially inwardly from the first casing and extends circumferentially about an array or rotor blades.

Several patents show containment structures formed from synthetic fibers which are woven into a fabric or webbing. U.S. Pat. No. 4,057,359 entitled "Ballistic Nylon Fabric Turbine Governor Housing Shielding Means" issued to Grooman shows a flexible housing cover formed by stitching together two sections of a ballistic nylon fabric. The cover fits over the housing and is held in place by a removable band. U.S. Pat. No. 3,602,602 issued to Motta entitled "Burst Containment Means" shows a containment means formed of a winding of tape over a machinery housing and aligned with the expected path of travel of part fragments to contain the part fragments during a failure of the rotary machine. The cross-sectional view of the housing shows a solid housing. A contemporaneous recommendation for a containment structure appears in a NASA Final Report entitled "Development of Advanced Lightweight Containment Systems". This report was made under NASA Contract No. NAS3-21823. The containment structure includes a honeycomb backed steel shell, a fabric extending circumferentially about the shell and felt material trapped radially between the fabric and a honeycomb backed steel shell.

In spite of this progress in containment structures, scientists and engineers are seeking to develop an apparatus for positioning a fabric containment means for containing particles released from an array of rotor blades.

DISCLOSURE OF INVENTION

According to the present invention, a hollow, annular beam which has a plurality of annular plates extending circumferentially about the interior of the beam is mounted in a gas turbine engine to support and position a fabric for containing blade fragments having a radial velocity.

In accordance with the present invention, a method for forming the hollow beam includes the steps of inserting a plurality of annular plates between two circumferentially continuous walls which are spaced radially and joining the annular plates to both walls. One detailed method includes disposing annular plates between the walls which have an inner leg and an outer leg, in abutting contact with the walls and passing a single stream of directed energy through the outer and inner walls and the outer and inner legs to form a weld between the walls and the legs.

A primary feature of the present invention is an annular, hollow beam. The annular beam has an inner wall and an outer wall spaced radially from the inner wall. A plurality of annular plates extend circumferentially about the interior of the beam. The annular plates are attached to the outer wall and the inner wall. In one embodiment, the beam has a characteristic vibratory pattern at the inner wall having nodes and antinodes. Each annular plate is attached to the inner wall at an antinode. In one detailed embodiment, the annular plate has a C-shaped cross-section. The C-shaped cross-section is formed of a radially extended rib and two axially oriented legs. The annular plates are oriented to face the legs in a single, generally axial direction.

A principle advantage of the present invention is the radial stiffness and the weight of the beam for supporting the fabric about the axis of the engine which results from the configuration of the hollow beam. Another advantage is the capability of the beam to support a fabric outwardly of the beam, a rub strip inwardly of the beam and adjacent structure which results from the axial rigidity, the radial rigidity, and the circumferential rigidity of the beam. Another advantage of the present invention is the capability of the structure to permit penetration through the structure by blade fragments and to maintain structural integrity after such penetrations which results from the hollow construction and the annular plates which extend between the inner wall and the outer wall of the beam. Another advantage is the ease of manufacture and inspection during fabrication which results from access to the annular plates of the hollow beam during fabrication. In one embodiment, the ease of manufacture is promoted by the configuration of the annular plates.

Other features and advantages will be apparent from the specification and claims and from the accompanying drawings which illustrate an embodiment of the invention.

BEST MODE FOR CARRYING OUT THE INVENTION

Figure 1:
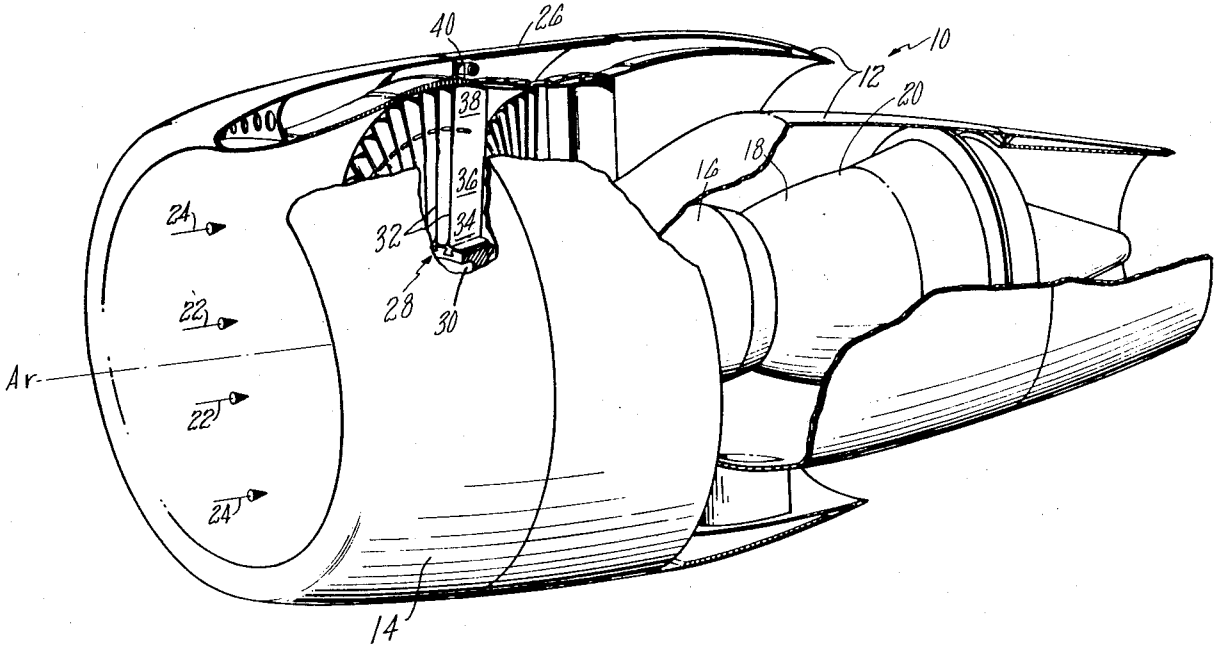
FIG. 1 is a perspective view of an axial flow gas turbine engine mounted in an aircraft nacelle with a portion of the nacelle and the engine broken away to show an array of rotor blades and the adjacent fan case structure in the engine.

A gas turbine engine 10 of the axial flow, turbofan type is shown in FIG. 1. A nacelle 12 circumscribes the engine and is adapted to support and position the engine from a support structure such as an aircraft wing (not shown). The engine is formed of a fan section 14, a compressor section 16, a combustion section 18 and a turbine section 20. A primary flow path 22 for working medium gases extends rearwardly through these sections. A secondary flow path 24 for working medium gases outwardly of the primary flow path extends rearwardly.

The fan section 14 includes a stator assembly 26 and a rotor assembly 28. The rotor assembly has an axis of rotation $A_r$. The rotor assembly includes a rotor disk 30 and a plurality of rotor blades 32. Each rotor blade has a root region 34, a midspan region 36 and a tip region 38. Each rotor blade extends outwardly across the working medium flow paths into proximity with the stator assembly. The stator assembly includes a fan case 40 which extends axially and circumferentially to circumscribe the working medium flow path.

Figure 2:
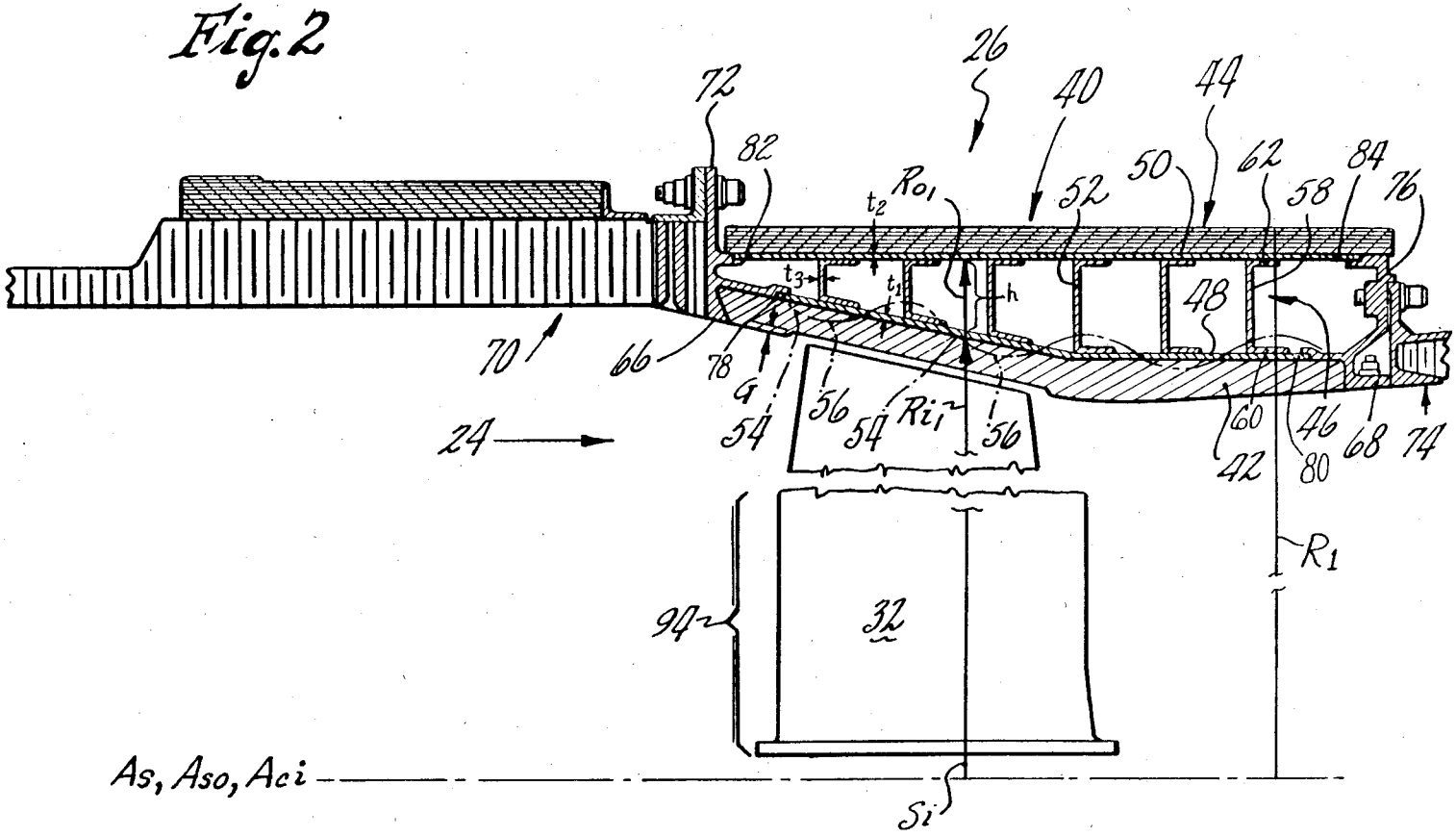
FIG. 2 is a cross-sectional view of the fan case structure adjacent the rotor blade and is a side elevation view of the rotor blade with portions of the rotor blade broken away.

FIG. 2 is an enlarged cross-sectional view of the stator of assembly 26 and shows a portion of the fan case 40 and one of the rotor blades 32 with portions of the rotor blade broken away. Each rotor blade is spaced radially from the fan case during normal operation leaving a gap G therebetween. The fan case outwardly of the rotor blade is formed of a shroud such as a rub strip 42, a fabric 44 and a structure for supporting the rub strip and the fabric such as the annular beam 46. The term "fabric" includes, but is not limited to, tape, woven material or the like. The fabric 44 extends circumferentially about the annular beam.

The annular beam 46 is hollow and has an axis of symmetry $A_s$. The annular beam extends axially and circumferentially about the axis of symmetry. The annular beam has a first wall, such as the inner wall 48 and a second wall such as the outer wall 50. The outer sheet is spaced radially from the inner sheet leaving a gap therebetween. A plurality of annular plates 52 extend circumferentially about the interior of the annular beam for stiffening the beam against radial deflection. Each annular plate is ridgidly attached to the inner wall and to the outer wall of the annular beam. One material thought to be satisfactory for the walls and the annular plates is a titanium alloy AMS (Aerospace Material Specification) 4911. The titanium alloy is used in a beam having an inner diameter of approximately eighty inches (80 in.). The inner wall has thickness $t_1$ of ninety-thousandths of an inch (0.090 in.). The outer wall has a thickness $t_2$ of thirty-thousandths of an inch (0.030 in.). The annular plate has a thickness $t_3$ of thirty-thousandths of an inch (0.030 in.). The ratio of the radial height h of the annular plate to the combined thickness of the inner and outer plates $(t_1+t_2)$ is greater than or equal to five to one $$\left(\frac{H}{t_1+t_2} \geqq 5\right)$$

The annular beam 46 has a characteristic vibratory pattern at the inner wall 48, as shown by the broken line, which includes spaced apart nodes 54 and antinodes 56. Each annular plate is attached to the inner wall at an antinode. Each annular plate has a C-shaped cross-section. The cross-section is formed of a radially extending rib 58, a first leg such as the inner leg 60 and a second leg such as the outer leg 62. The inner leg and the outer leg extend in an axially oriented direction. The inner leg and the outer leg are rigidly attached to the inner and outer walls such as by riveting, diffusion bonding, welding, or the like. Alternatively, the inner leg and outer leg may also be flexibly attached to the walls by bonding the walls to the leg with an adhesive. The inner leg is spaced radially from the outer leg and radially faces the outer leg such that a radial line $R_1$ perpendicular to the axis of symmetry $A_s$ of the annular plate passes through both legs. Because the legs adapt the annular plate to engage the walls and are in abutting contact with the walls, the inner leg or the outer leg may have a cylindrical or frustoconical shape to conform to the shape of the abutting wall. For example, at least one of the annular plates has a cylindrical inner leg and a cylindrical outer leg. At least one of the annular plates has a cylindrical outer leg and a frustoconical inner leg.

The hollow, annular, beam 46 has a first end, such as the upstream end 66, and a second end spaced axially from the first end, such as the downstream end 68. A first structure 70, is axially adjacent to the annular beam at the upstream end of the beam. The annular beam has a first flange 72 which adapts the beam to support the axially adjacent first structure. A second structure 74 is axially adjacent to the annular beam at the downstream end of the beam. The annular beam has a second flange 76 which adapts the beam to be supported by the axially adjacent second structure. The inner wall 48 of the beam has a first edge, such as upstream edge 78, and a second edge such as the downstream edge 80. The upstream edge adapts the wall to be joined to the upstream flange 72, and the downstream edge adapts the wall to be joined to the downstream flange 76. The outer wall has a first edge, such as upstream edge 82 and a second edge such as the downstream edge 84. The upstream edge adapts the wall to be joined to the upstream flange 74 and the downstream edge 84 adapts the wall to be joined to the downstream flange 76.

Figure 3:
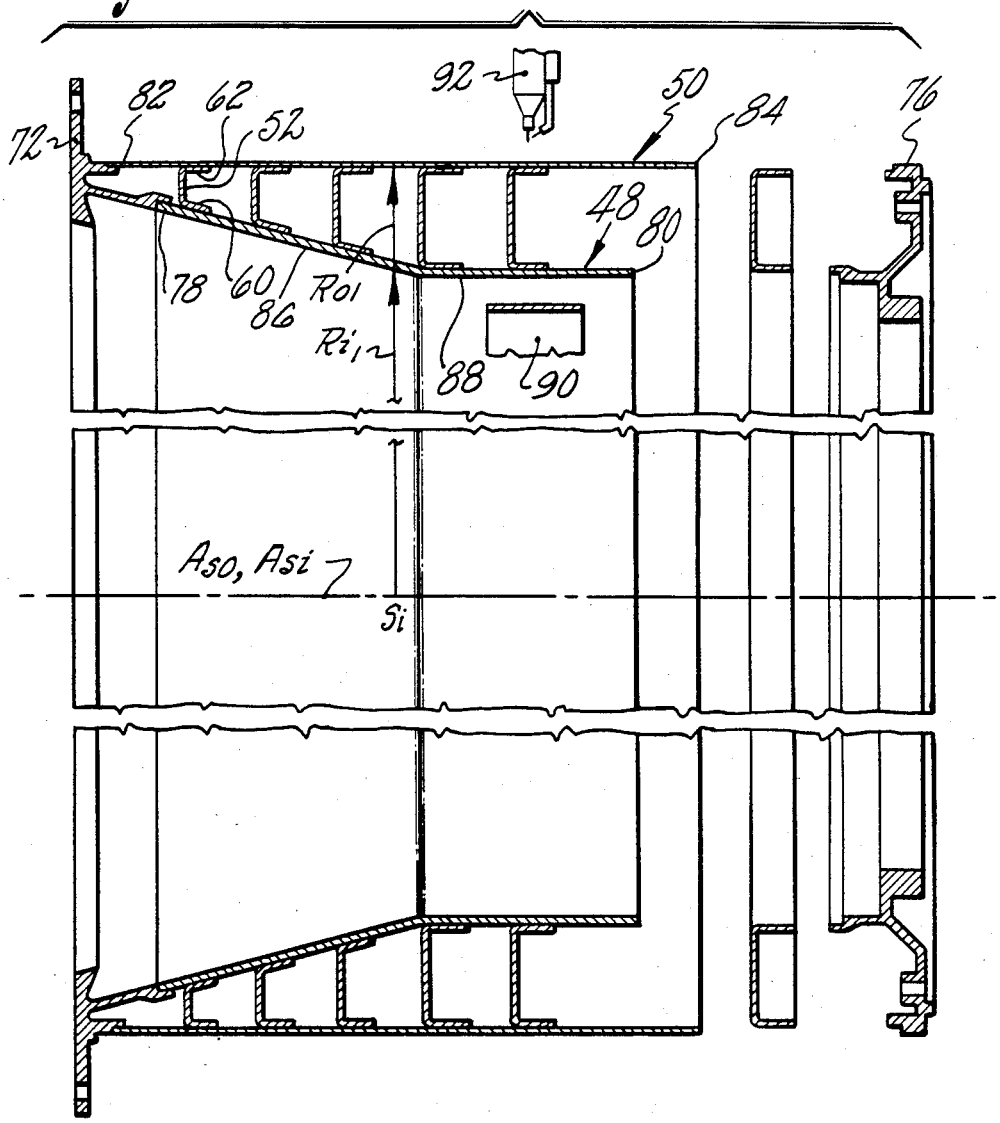
FIG. 3 is an exploded, schematic illustration of the support structure show in FIG. 2 illustrating the method of assembling the support structure.

FIG. 3 is an exploded view of the support structure shown in FIG. 2 and illustrates a method for forming the support structure. The outer wall 50 is formed of two sheets having circumferentially facing ends which are butt welded together to form a first cylindrical hoop and a second cylindrical hoop. The first and second cylindrical hoops are butt welded together to form a single cylindrical wall. The cylindrical wall is the outer wall in the installed condition the outer wall is circumferentially continuous, has an axis of symmetry $A_{so}$ and is spaced a first distance $Ro_1$ from the axis of symmetry at any section $S_1$ perpendicular to the axis of symmetry. The inner wall 48 is formed of two sheets. Each sheet has circumferentially facing ends which are butt welded together to form either a frustoconical hoop 86 (first sheet) or a cylindrical hoop 88 (second sheet). The hoops are butt welded together to form an outer wall having a frustoconical portion transitioning into a cylindrical portion. The inner wall is circumferentially continuous, has an axis of symmetry $As_i$ and is spaced a second distance $Ri_1$ from the axis of symmetry at the section $S_1$. The second distance $Ri_1$ is smaller than the first distance $Ro_1$ ($Ri_1 < Roi_1$).

The inner wall 48 is disposed axially and radially with respect to the outer wall 50 such that the outer wall is axially aligned with the inner wall and is spaced radially from the inner wall leaving a gap therebetween. The inner wall and the outer wall are located with respect to each other and the annular plate by attaching an endmost C-shaped annular plate 52 to the walls. As shown, the endmost annular plate is the annular plate nearest the edges of the walls (upstream edges 78, 82). The annular plate is oriented to face the legs toward downstream edges 80, 84 of the walls. One satisfactory method of attaching the annular plate to the walls is by resistance spot welding the walls to the legs 60, 62 of the annular plate. The spot welds are circumferentially spaced and place each leg in abutting contact with the wall. The spot welds locate the walls with respect to the annular plate during the assembly procedure and are not intended to permanently join the annular plate to the walls. After spot welding the first C-shaped annular plate to the inner sheet 48 and the outer sheet 50, the adjacent C-shaped flange is slid past the downstream edges 80, 84 of the walls into position between the walls. Because the inner leg 58 of the stiffener has the same frustoconical shape as the frustoconical portion of the inner wall, the stiffener locates itself axially with respect to the inner wall. The second C-shaped flange is attached to the walls, such as by resistance spot welding, to locate the second annular plate during the assembly procedure. In a like manner, the remaining plates are assembled to the walls. A distinct and particular advantage of this assembly procedure is that the orientation of the legs during assembly which enables the inspection of each resistance spot weld as each C-shaped annular plate is inserted and spot welded. The inspection insures that the legs of the stiffener are in abutting contact with the inner wall and outer wall.

The subassembly comprising the inner wall 48, the outer wall 50 and the C-shaped annular plates 52 is mounted on a second fixture to ensure that the annular beam has a proper concentricity and diameter. The fixtured subassembly is mounted in a welding chamber such as an electron beam weld chamber. A welding shield 90 is mounted inwardly of the inner sheet. A device for forming a beam of directed electromagnetic or electronic energy such as an electron beam welder 92 is positioned radially outwardly of the outer wall and is aligned with the legs 60, 62 of a C-shaped annular plate to pass the stream of energy on a radial line $R_e$ through both the inner leg 60 and the outer leg 62. The case is rotated in alignment with the beam of energy. The electron beam passes through the outer wall, the outer leg, the inner leg, and the inner wall and impinges on the shield. The electron beam causes fusion to occur between the legs of the plate and the inner and outer wall, permanently joining the C-shaped plate to the inner and outer walls. In a like manner the remaining C-shaped walls are joined to the inner and outer walls. The interior of the inner wall is inspected for evidence of welding to insure that the electron beam has gone all the way through to the interior of the case. The inspection establishes that a weld exists between the inner wall and the inner leg and between the outer wall and the outer leg. After the inspection the upstream flange 72 and the downstream flange 76 are fusion welded to the sheets with a heliarch welding process. In an alternate method, the endmost annular plate which locates the inner wall 48 and the outer wall 50 is permanently joined to the walls before the insertion of the adjacent plate. A continuous weld is formed between the plate and the walls by welding the components with a suitable welder such as an arc welder, a resistance welder, an oxyacetylene welder or an electron beam welder. The step of joining the annular plate to the walls which is performed immediately after the step of inserting the annular plate, includes joining the outer leg to the outer wall and the inner leg to the inner wall. Each of the remaining annular plates is oriented to face the legs in the same axial direction as the first plate. Each annular plate that is inserted is joined to the inner wall and the outer wall before the insertion of any remaining annular plates. Because of the orientation of the legs 60, 62 both welds may be made simultaneously with a welder such as a resistance welder. After welding of the plate, both welds may be inspected.

During operation of the engine, the rotor assembly 26 rotates at speeds as high as four thousand revolutions per minute (4,000 rpm) about the axis of rotation $A_r$. As the rotor assembly rotates, the rotor disk 30 exerts a centripetal force on the root region 34 of each blade causing the blade to follow a circular path about the axis of rotation. The impact of a foreign object on the blade may cause the blade to fail in the root region. Upon failure, the centripetal force acting on the blade is eliminated and the blade moves radially outwardly across the gap G. The blade strikes the rub strip 42. The fragments of the tip region move axially forwardly with relatively high axial velocity because of the shape of the flow path and because of the difference in pressure which exists between the leading edge and the trailing edge of the blade. Typically, the tip region 38 of the blade breaks off from the rotor blade leaving behind as a unit the root region 34 and the midspan region 36 of the blade. The midspan and base region of the blade form a second portion 94 of the blade which moves radially outwardly across the radial distance occupied by the tip region and across the gap G to strike the rub strip. As the second portion of the blade moves outwardly with a radial velocity, the second portion of the blade is struck from behind by the adjacent (following) blade. The impact of the following blade drives the blade rearwardly and circumferentially, imparting an axially rearward velocity to the blade and increasing the tangential velocity of the blade. The second portion of the blade is of larger size than the tip region particle and as a result is stronger than the tip region of the blade. The strength and mass of the second portion of the blade enables the second portion of the blade to penetrate both the rub strip and the hollow beam without shattering. The hollow beam is dimensioned such that the second portion of the blade penetrates through the inner wall and the outer wall. The hollow beam accepts the penetration of the second portion of the blade enabling the blade fragment to reach the fabric and positions the fabric to receive the impact of the blade.

The annular beam accepts the penetration of the blade to permit the fabric to perform the containment function. As the blade fragment passes through the inner wall and the outer wall, the blade exerts local shearing forces on the inner wall and the outer wall which are transmitted to the flanges through the walls and the annular plates which tie the walls together. The second portion of the blade strikes the fabric. The fabric deflects outwardly away from the case trapping the blade fragment between the case and the fabric.

A particular advantage of the present invention is the capability of the annular beam to accept the penetration of both walls by the fragment and yet to maintain its stiffness and its ability to position the fabric about the engine which results from the configuration of the beam. As the blade fragment penetrates the hollow beam it may locally destroy a portion of the annular flanges which extend circumferentially about the interior of the hollow beam. The adjacent flanges and the adjacent portions of the flange to the area of injury provide the necessary stiffness to support the fabric in its correct position. The weight of the beam is low as compared with solid beams of equivalent stiffness by reason of the radial height of the annular beam. The radial height displaces a substantial portion of the mass of the hollow beam from the neutral axis of the beam increasing the moment of inertia of the beam about the neutral axis and thus the radial stiffness of the beam as compared with a solid beam. Thus the case maintains required radial stiffness and axial stiffness to position the fabric and rub strip and yet accepts penetrations by such large fragments.

Although the invention has been shown and described with respect to preferred embodiments thereof, it should be understood by those skilled in the art that various changes and omissions in the form and detail thereof may be made therein without departing from the spirit and scope of the invention.

We claim:

1. A method of manufacturing a casing for a gas turbine engine which engine casing includes a structure for positioning and supporting a fabric radially outwardly of a working medium flow path in a gas turbine engine to contain paritcles having a radial velocity, and includes a fabric disposed about the structure, the method including:

disposing a first wall axially and radially with respect to a second wall such that the second wall is axially aligned with the first wall and is spaced radially from the first wall leaving a gap therebetween;

forming a plurality of annular plates having an inner leg, an outer leg, and a rib extending in a generally radial direction between the inner leg and the outer leg such that a straight line passes through theouter leg and the inner leg;

inserting at least one annular plate into the gap between the first wall and the second wall and axially spacing each annular plate from any adjacent annular plates;

joining each of the annular plates to the inner wall and the outer wall; and, disposing a fabric about the structure;

wherein the step of inserting each of the annular plates includes the step of locating each annular plate with respect the first wall and the second wall by attaching each leg to the associated wall at circumferentially spaced locations to place the leg in abutting contact with the wall such that a straight line passes through the outer leg, the inner leg and the walls, and wherein the step of joining the outer leg to the first wall and the inner leg to the second wall is performed after the step of inserting the annular plates and includes the step of mounting the subassembly of the inner wall, the outer wall and the annular plates in a fixture and positioning a welder outwardly of the outer wall to pass a stream of energy on a line through the outer wall, the outer leg, the inner leg and the inner wall to provide a circumferentially continuous weld between the leg and the wall.

2. The method of forming the structure of claim 1 wherein the step of joining the walls to the legs includes the step of rotating the case with respect to an electron beam welder and passing the electron beam through the outer wall, the outer leg, the inner leg and the inner wall to permanently join the annular flange to the walls with a continuous weld.

3. The method of forming the structure of claim 1 wherein the method of locating each annular plate with respect to the walls includes the step of spot welding the plate to the adjacent walls at circumferentially spaced locations.

4. The method of forming the structure of claims 1, 2, or 3 which includes the step of joining a first flange to the front edges of the walls and a second flange to the rear edges of the walls.

5. A method of manufacturing a casing for a gas turbine engine which engine casing includes a structure for positioning and supporting a fabric radially outwardly of a working medium flow path in a gas turbine engine to contain particles having a radial velocity, and includes a fabric disposed about the structure, the method including:

disposing a first wall axially and radially with respect to a second wall such that the second wall is axially aligned with the first wall and is spaced radially from the first wall leaving a gap therebetween;

inserting at least one annular plate into the gap between the first wall and the second wall to locate the first wall with respect to the second wall by attaching each of the walls to one of said annular plates and axially spacing each annular plate from any adjacent annular plates;

joining each of the annular plates to the inner wall and the outer wall; and, disposing a fabric about the structure;

wherein each annular plate has a rib extending in a generally radial direction and an inner leg and an outer leg extending from the rib in a generally axial direction, wherein the step of locating the first wall with respect to the second wall includes the step of orienting the annular plate such that the legs face in a first generally axial direction, wherein the step of inserting at least one annular plate includes the step of orienting each additional annular plate such that the legs face in the first direction, and wherein the step of joining the annular plate to the first wall and the second wall is performed immediately after the step of inserting each annular plate and includes joining the outer leg to the first wall and the inner leg to the second wall.

* * * * *